United States Patent [19]

Shulski et al.

[11] Patent Number: 4,578,976

[45] Date of Patent: Apr. 1, 1986

[54] CONTAINER PROCESSING APPARATUS

[75] Inventors: Michael M. Shulski, Northfield; John M. Mann, Downers Grove, both of Ill.

[73] Assignee: National Can Corporation, Chicago, Ill.

[21] Appl. No.: 598,076

[22] Filed: Apr. 9, 1984

[51] Int. Cl.[4] ..... B21D 15/02

[52] U.S. Cl. ..... 72/105; 72/465

[58] Field of Search ..... 72/94, 102, 105, 106, 72/465; 220/72

[56] References Cited

U.S. PATENT DOCUMENTS

| | | | |
|---|---|---|---|
| 606,856 | 7/1898 | Campen | 220/72 |
| 744,231 | 11/1903 | Puddefoot | 72/105 |
| 1,262,289 | 4/1918 | Weber | 220/72 |
| 3,150,707 | 9/1964 | Howell | 72/177 |
| 4,059,000 | 11/1977 | Bodnar | 72/465 |
| 4,316,375 | 2/1982 | Lee, Jr. | 72/105 |
| 4,487,048 | 12/1984 | Frei | 72/105 |

FOREIGN PATENT DOCUMENTS

| | | | |
|---|---|---|---|
| 889981 | 2/1962 | United Kingdom | 72/94 |

*Primary Examiner*—Lowell A. Larson

*Attorney, Agent, or Firm*—Robert A. Stenzel; Ralph R. Rath

[57] ABSTRACT

A container embossing apparatus includes a container-supporting embossing mandrel that has circumferentially-spaced, axially-extending ribs on the periphery that are engageable with a resilient forming mandrel or member so that crease lines are formed on the container during the embossing operation.

10 Claims, 6 Drawing Figures

2
2
12
14
16
18
20
22
24
26
30
34
36
38
39
50
52
54
56
58
60
62
64
66
68
70
72
74
76
78

CONTAINER PROCESSING APPARATUS

DESCRIPTION

1. Technical Field

The present invention relates generally to the manufacture of containers and, more particularly, to an apparatus for conditioning a container to improve the appearance thereof, as well as increase certain strength characteristics of the container.

2. Background Prior Art

The use of a two-piece container has become very common in the beer and beverage industry. The two-piece container consists of a unitary body that forms the sidewall of the container and has an end wall integral therewith at one end which is usually formed to a dome-shaped configuration to increase the overall strength of the container. The opposite open end of the container has an end seamed thereto after the product has been inserted into the container.

In the manufacture of containers of this type, a sheet of stock material of predetermined thickness is fed to a cupping press wherein discs are cut from the stock material and are transformed into cups that have a diameter which is considerably larger than the ultimate diameter of the finished container.

The preformed cups are then transferred to a container-forming apparatus, commonly referred to as a bodymaker, wherein the cup is aligned with a punch carried by a reciprocable ram and cooperates with a plurality of spaced ironing dies and a doming mechanism located at the end of the path for the punch. During the formation process, the punch initially cooperates with a redraw assembly in which the shallow cup is redrawn to a smaller diameter cup that has an internal diameter which is equal to the internal diameter of the ultimately-finished container and a height that is greater than the height of the original cup. Each cup then passes through a series of ironing dies having progressively reduced diameters so that the sidewall of the container is progressively reduced in thickness, while the height of the container increases. At the end of the stroke for the punch or ram, the end of the container is forced into a predetermined configuration of a dome and the integral end wall is reformed to increase the strength thereof.

After the container has been reformed in the bodymaker, which is commonly referred to as the drawing and ironing process, the uneven or ragged free edge of the open end of the container is trimmed to provide a finished product of predetermined height and the upper open end then has a reduced neck and an outwardly-directed flange formed thereon, which is used to ultimately seam an end thereto.

In the more recent types of containers that are being produced, the necking process consists of forming the reduced neck in two or more stages of reduction so that smaller diameter ends can be utilized thereby reducing the overall cost of the metal required for the formation of the containers. The progressively-reduced neck not only reduces the necessary diameter of the end but also provides additional strength adjacent the open end of the container and enhances the package when it is presented to the consumer with the product therein.

Of course, with the increased costs of the raw material, such as aluminum or steel, manufacturers are constantly striving to reduce the amount of stock material necessary to produce a container that can be sold at a competitive price.

With the increased efficiency in the can-making process, manufacturers are now capable of manufacturing containers at the rate of 200 containers per minute or more from a single bodymaker with the majority of the container sidewall having a thickness on the order of about 0.004 inches or less.

Difficulties have been encountered in processing of the containers in the can manufacturing line in that the thin walls and the merging section between the sidewall and the domed end have a tendency to become dented during the transfer of containers during transportation along guide rails between the various processing stations.

Another area that has received a remarkable degree of attention in the manufacture of metal containers is the overall appearance of the final product. Because of the fierce competition in the packaging industry, not only among metal container manufacturers, particularly the beer and beverage industry, but also between metal containers, glass bottles and plastic containers, manufacturers are constantly striving to gain a competitive edge by producing a product that not only meets the rigid structural requirements at a low cost, but is also aesthetically pleasing to the ultimate consumer to entice the consumer into selecting the packaged product.

SUMMARY OF THE INVENTION

According to the present invention, a process has been developed which can readily incorporate embossments into a container body to enhance the appearance thereof, as well increase the structural characteristics of the container. More specifically, the embossments can be added into any existing container manufacturering line for two- or three-piece containers without any significant modification thereof.

The apparatus consists of a mandrel that is rotatable about a fixed axis and has a container-loading mechanism axially aligned therewith. The mandrel has a plurality of circumferentially-spaced, axially-extending rigid projections on the periphery thereof and a resilient member is rotatable adjacent the mandrel in a position to be engageable with the periphery of the mandrel to produce crease lines along the axial dimension of the metal container that are interconnected by generally planar or chordal portions resulting in the embossed container.

In its preferred embodiment, each projection has a length that is less than the overall length of the container so that the crease lines terminate inwardly of opposite ends of the container to provide a rather pleasing transition between the embossments and the remaining circular main body of the container at opposite ends of the crease lines.

In one embodiment of the invention, the resilient member or forming mandrel is pivoted on the frame adjacent the container-supporting mandrel or embossing mandrel and is moved into and out of engagement with embossing mandrel by cams so that the forming mandrel is only in driving engagement with the container-supporting mandrel during the actual embossing operation. Preferably, the two mandrels are rotatably driven at synchronized speeds to prevent relative rotation between the mandrels during the embossing operation.

In a modified form of the invention, the resilient member is an arcuate segment formed on a cam member that is continuously rotated about a fixed axis parallel to and spaced from the fixed axis of rotation for the embossing mandrel. In this embodiment of the invention, the resilient arcuate segment, equivalent to the forming mandrel, has a circumferential dimension approximately equal to the circumferential dimension of the embossing mandrel.

According to a further aspect of the invention, both embodiments described above could readily be embodied into existing types of commercial container trimming machines, such as the type illustrated in U.S. Pat. No. 3,838,653, incorporated herein by reference with certain modifications.

BRIEF DESCRIPTION OF SEVERAL VIEWS OF DRAWINGS

DETAILED DESCRIPTION

Figures 1, 2, 2A:
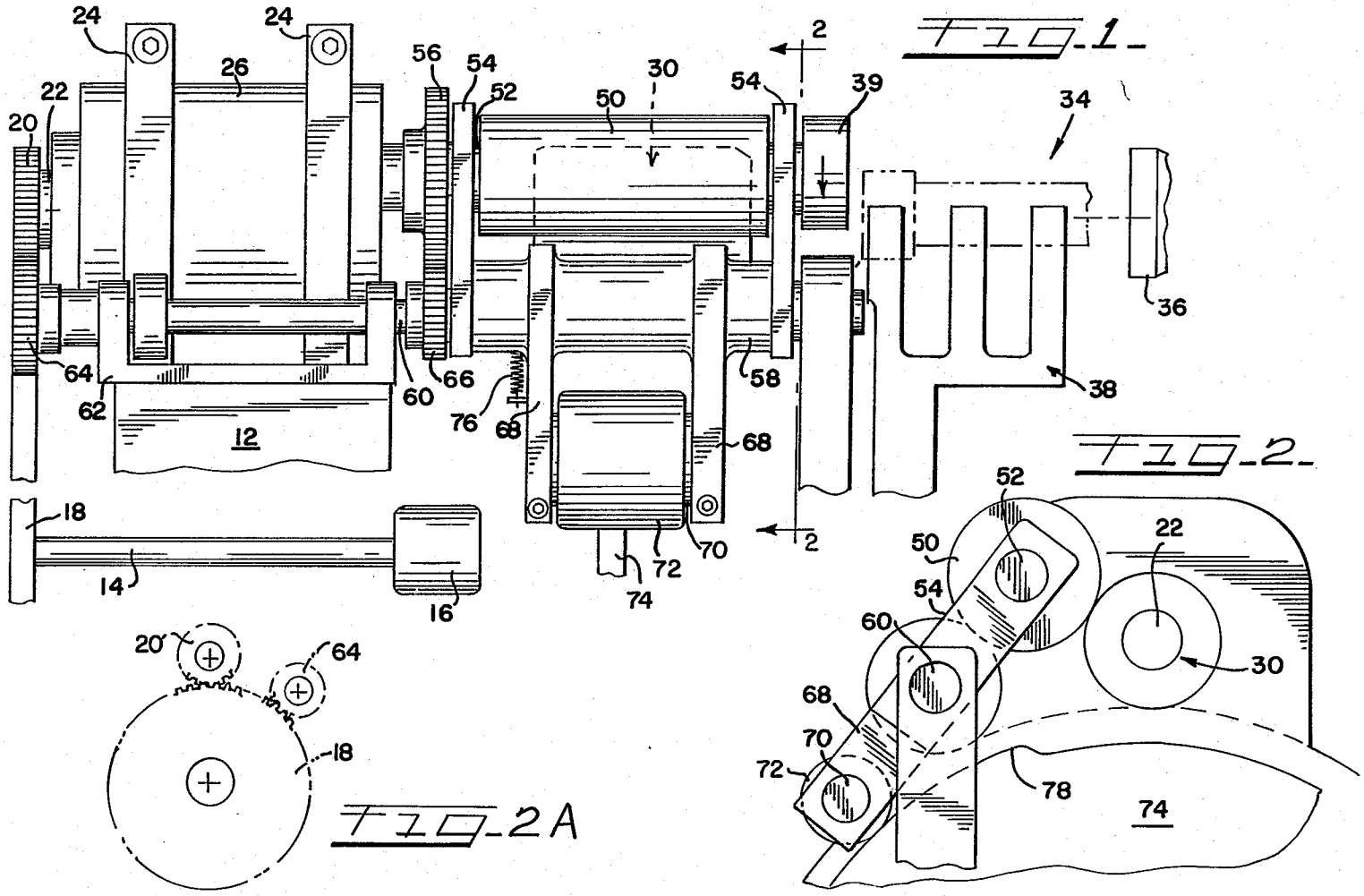
FIG. 1 shows a fragmentary side elevation view of a container processing apparatus having the present invention incorporated therein.
FIG. 2 is an enlarged fragmentary end view as viewed along line 2—2 of FIG. 1 showing details of the apparatus.
FIG. 2A is a fragmentary end view of the drive mechanism, as viewed along line 2A—2A of FIG. 1.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 of the drawings generally discloses a container processing apparatus, which is generally designated by reference numeral 10. The container processing apparatus 10 is preferably an apparatus such as disclosed in the above-mentioned patent which discloses a trimming apparatus for trimming the uneven edge of a drawn and ironed container. According to the present invention, the container trimming apparatus is modified to produce an apparatus that is capable of embossing a container, as will be described below.

The container processing apparatus 10 generally includes a base or support structure 12, only a portion of which is shown in FIG. 1. A main drive shaft 14 is rotatably supported about a fixed axis on base 12 and is driven by a suitable motor 16. Main drive shaft 14 has a large gear 18 fixed thereto for rotation therewith which is in mesh with a second gear 20 that is mounted on a further driven shaft 22 extending parallel to the shaft 14. Driven shaft 22 is supported on bearings in housing 26 which is clamped by brackets 24, so that the shaft 22 is rotated about a fixed stationary axis. One end of the shaft 22 has a mandrel 30 (FIG. 2) supported thereon for rotation therewith.

A container-loading mechanism, generally designated by reference numeral 34, is supported on base 12 and is adapted to receive and move a container onto the mandrel 30 for processing thereon. The container-loading station includes a reciprocable plunger 36 which is reciprocated through suitable drive means (not shown), such as a fluid ram, for movement along an axis that is coincident with the axis for main shaft 22. Containers are constantly supplied through a starwheel 38 which is rotatable about a fixed axis and has a plurality of circumferentially-spaced pockets which are sequentially indexed into alignment with the plunger 36. The plunger 36 is movable from the solid line position illustrated in FIG. 1 to the dotted line position for moving a container from a receiving station or starwheel 38 onto the mandrel 30.

The apparatus so far described is generally of the type disclosed in the above-mentioned patent and patents cited therein, which is specifically designed for trimming of uneven edges of containers after the containers have been processed in the drawing and ironing machine. This type of apparatus has been commercially available from the Assignee of the present invention, as well as other manufacturers, with only minimum modification thereof. The prior trimming apparatus is designed such that the drive shaft 14 is continuously rotated and, in turn, rotates driven shaft 22 and mandrel 30. The starwheel 38 is periodically indexed to align a pocket with the mandrel 30 and plunger 36 with a container thereon. The mandrel is then actuated through a fluid cylinder (not shown) and the container is moved from the starwheel 38 through a locating collar 39 onto the continously-rotating mandrel 30.

In the prior art trimming apparatus, a trimming knife, located on a cam member (not shown), fixed to and rotatable with drive shaft 14, cooperates with a cutting element adjacent one end of the mandrel 30 to trim the edge of the container. After the uneven edge of the container has been removed, the container is then removed from the mandrel, such as by forcing air through the shaft 22 and blowing the container off the mandrel back to the pocket on the starwheel. The starwheel is then indexed and the process is repeated.

According to the present invention, the container trimming apparatus of the prior art type that is commercially available has been slightly modified so that the apparatus can be utilized for producing an embossed container. The apparatus for producing embossed containers includes the mechanism described above, with only minor modifications, so that a container supported on the mandrel can readily be reformed from a circular configuration to a generally non-circular configuration having a very aesthetic appearance.

More specifically, the mandrel 30 is modified in a manner that will be described later and the general apparatus is further modified to provide a member that cooperates with the mandrel to form the embossed container, as will be described later.

Figure 3:
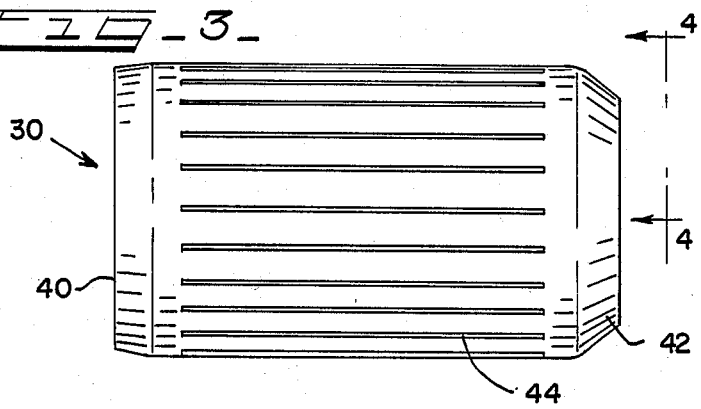
FIG. 3 is an enlarged side elevational view of the embossing mandrel forming part of the apparatus shown in FIG. 1.
Figure 4:
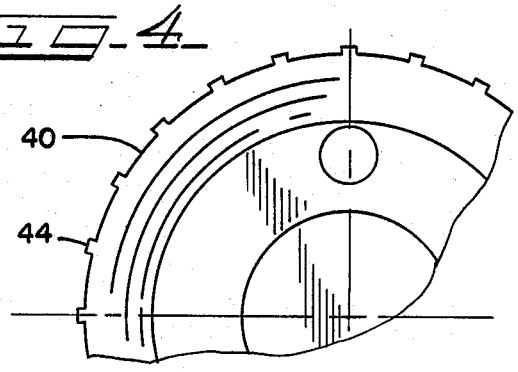
FIG. 4 is an enlarged end view as viewed along line 4—4 of the mandrel shown in FIG. 3; and, FIG. 5 is an enlarged fragmentary end view of a modified form of the invention.

The mandrel utilized in the present invention is generally shown in FIGS. 3 and 4 and consists of a generally cylindrical solid member 40, formed from a hard metal, which is tapered at one end 42 to conform generally to the configuration of the integral end wall of the container supported thereon. The rigid circular member 40 has a plurality of circumferential, equally-spaced projections 44 thereon extending from the periphery thereof. The projections are generally rectangular or square in cross-section, as seen in FIG. 4, and the projections terminate inwardly of opposite ends of the circular member, for a purpose that will be described later.

A resilient member 50 (FIG. 2) is mounted adjacent the mandrel 30 to cooperate therewith and to perform the embossing function.

The resilient member or mandrel 50 is keyed to a shaft 52 that is rotatably supported on a pair of bracket arms 54 and has a gear 56 fixed to one end thereof. The bracket arms 54 are secured to a hollow sleeve 58 that is rotatable on a drive shaft 60. Shaft 60 is rotatably supported in bearings in a U-shaped bracket 62 supported on base 12 and is driven through a gear 64 thereon in mesh with main drive gear 18 and drives resilient mandrel 50 through gear 66 in mesh with gear 56 on shaft 52.

Hollow sleeve 58 also has a further pair of arms 68 secured thereto and the outer ends of arms 68 support a pin 70 which rotatably supports a cam follower 72.

Cam follower 72 is biased toward a cam member 74 through a spring 76 and cam member 74 has a raised portion 78 which pivots the arms 54, 68 and sleeve 58 on shaft 60 and, in turn, the resilient member 50, as will be described later. Raised portion 78 of the cam will be long enough to force engagement between mandrel 30 and resilient member 50 for approximately one complete revolution at synchronized speed provided by proper selection of the size and gear ratios of the respective gears 56, 64 and 66. The resilient member may be in the form of various materials, but preferably is a rubber or deformable plastic member that cooperates with the projections, as will be described later.

In the operation of the embodiment described, the container processing apparatus is operated in the same general fashion as previously in connection with the trimming of container bodies. Initially, containers are supplied to the various pockets on the starwheel 38 and the starwheel is consecutively indexed to align a pocket with the plunger 36, which is then extended and carries the container from the starwheel onto the rotating mandrel 30. After the container has been positioned on the embossing mandrel, the continuous rotation of the cam member 74 will cause the cam surface 78 of cam 74 to move cam follower 72, which in turn will pivot and force the resilient member or forming mandrel 50 into engagement with the periphery of the container-supporting mandrel. The arms 54, hollow sleeve 58 and arms 68 may be considered a single pivoted link providing movement for the member 50.

As indicated above, the peripheral speeds of the forming mandrel 50 and mandrel 30 are sychronized so that the speeds are approximately equal to prevent any relative movement during the actual embossing process. The cam surface 78 is configured to provide movement of forming mandrel 50 to take up clearance between resilient member 50 and mandrel 30 and to further compress the two, thereby providing forming loads necessary to provide the embossed form.

In the actual operation, it has been determined that the metal essentially will be pinched along the leading edge of each of the projections and the adjacent forming member to produce a crease line and the metal will be somewhat stretched over the remainder of the projection so that a generally chordal portion will be formed between adjacent projections during the embossing operation. Also, by having the projections terminate inwardly of the opposite ends of the rigid circular member 40, the projections will likewise terminate inwardly of the opposite ends of the containers, and it has been determined that the particular configuration of the projections is such that there will be a smooth transition between the crease line and the remaining circular portion of the container at opposite ends thereof. This will also produce a more transitional change between the flattened chordal portions and the remainder of the circular container at opposite ends to produce what appears to be a generally scalloped configuration between the respective crease lines which is more apparent in different positions of tilt with the container axis relative to the eye of the potential purchasers.

The finished container is of the type that is generally disclosed in U.S. Ser. No. 523,514, filed Aug. 15, 1983, entitled "Design for an Embossed Can", incorporated herein by reference. The number and spacing of crease lines and chordal portions will to some extent depend upon the size of the container and the desired final appearance of the product.

From the above, it will be appreciated that an extremely simplified modification to an existing machine can readily be designed and implemented to produce the embossed container that has considerably greater aesthetic appeal than the circular containers that are presently on the market. Furthermore, the pleasingly-aesthetic container also has a certain inherent strength characteristic incorporated therein because of the configuration resulting from the embossment. Since the crease line or ridges are interconnected by chordal portions, it has been determined that the column strength of the thin-walled container is increased substantially, which has significant advantages during the filling operation where large axial loads are applied to the upper open end of the container by the filling machinery, as well as during the seaming process of the end onto the container.

Figure 5:
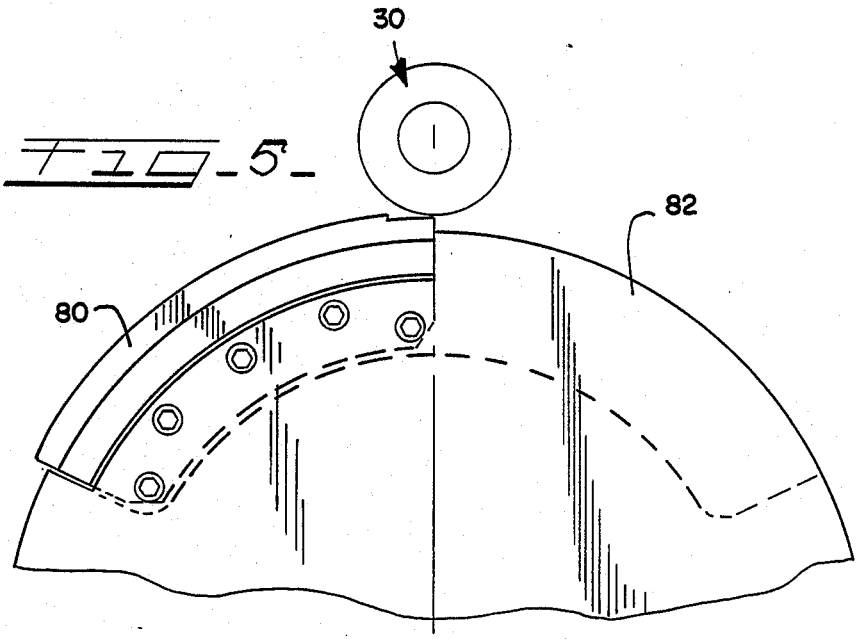

A slightly modified form of the invention is illustrated in FIG. 5 wherein the container-supporting or embossing mandrel 30 and the structure associated therewith is identical to that described in connection with the embodiment shown in FIG. 1 and in existing trimming mechanisms. In the embodiment shown in FIG. 5, the resilient member or forming member is in the form of an arcuate segment 80 which is formed on and extends beyond the periphery of a circular driven member 82 carried by the main drive shaft 14. The circular or arcuate member 80 has a circumferential peripheral dimension which is at least equal to the circumferential dimension of the container-supporting mandrel 30 and the mandrel and support member 82 are driven at a speed such that the peripheral speed of the arcuate, resilient member 80 is approximately equal to the peripheral speed of the container-supporting mandrel 30. In this embodiment, of course, the resilient member would have an elongated dimension at least equal to the axial dimension of the mandrel and would cooperate with the projections 44 in the same manner described above.

While specific embodiments have been illustrated and described, numerous modifications come to mind without significantly departing from the spirit of the invention.

For example, the embossing apparatus need not be embodied into an existing machine of the type described above, and could readily be formed as part of existing can-processing machinery. For example, the mandrel 30 could be incorporated into respective stations of multiple-stations on the periphery of a rotating turret. The respective mandrels could be simultaneously rotated by a common drive with a single resilient, rotatable or stationary member supported adjacent the periphery of the turret to be engageable and rotate with each of the separate container-supporting mandrels. For such an arrangement, the apparatus could readily be placed in a proper position in a can-manufacturing line to reduce the amount of container handling necessary for performing the embossing operation.

Of course, other modifications come to mind without departing from the spirit of the invention and the scope of protection is only limited by the scope of the accompanying claims.

We claim:

1. Apparatus for embossing a container comprising a base having a mandrel rotatable about a fixed axis thereon, and loading means on said base axially aligned with said mandrel for loading a container on said mandrel, said mandrel being formed from a rigid non-deformable material and having circumferentially-spaced, axially-extending projections on a periphery thereof, said projections being generally rectangular in cross-section, and a resilient member rotatable on said base and engageable with and cooperating with said projections on the periphery of said mandrel to deform said container between adjacent projections to produce crease lines along said container deformed by said projections and interconnected by generally planar portions between said crease lines resulting in an embossed container.

2. Apparatus as defined in claim 1, in which said projections have lengths less than the length of a container on said mandrel so that said crease lines terminate inwardly of opposite ends of said containers.

3. Apparatus as defined in claim 1, further including a link pivoted intermediate opposite ends on said base and in which said resilient member is a generally circular member rotatable about an axis generally parallel to said fixed axis, and means cooperating with an opposite end of said link for pivoting said resilient member into and out of engagement with said mandrel.

4. Apparatus as defined in claim 1, further including a generally circular disc rotatable about a second fixed axis parallel to and spaced from said fixed axis, said circular disc having a resilient segment extending from a periphery thereof which defines said resilient member, said resilient segment having a circumferential dimension at least equal to the circumferential dimension of said mandrel and being engageable with said mandrel during each revolution of said circular disc.

5. Apparatus for embossing a container comprising a base having a mandrel rotatable about a fixed axis thereon, said mandrel being generally circular in cross-section and having integral circumferentially-spaced, axially-extending projections on a periphery, loading means axially aligned with said mandrel for supplying containers to said mandrel, a driven shaft rotatable on said base about an axis parallel to and spaced from said fixed axis and having a cam rotatable therewith, a link pivoted about a parallel fixed axis on said base adjacent said mandrel and said cam and having opposite ends, a resilient member rotatable about an axis adjacent one end of said link and a cam follower on an opposite end of said link engageable with said cam to cause said resilient member to engage said mandrel during each revolution of said cam and grip said container between said resilient member and said projections to produce crease lines axially of said container interconnected by generally chordal segments.

6. Apparatus as defined in claim 5, further including common drive means for driving said mandrel, said cam and said resilient member at substantially synchronized speeds.

7. Apparatus for producing an embossed container comprising a base having a mandrel rotatable thereon, said mandrel comprising an elongated rigid generally circular core having a generally circular periphery and a plurality of circumferentially-spaced, axially-extending ribs projecting from the periphery thereof, means for moving a container onto said mandrel, a generally circular resilient member rotatably supported adjacent said mandrel, means for moving said generally circular resilient member into and out of engagement with a container on said mandrel and drive means for rotating at least one of said mandrel and said resilient member to produce relative rotation in opposite directions between said mandrel and said resilient member and emboss said container, said projections having means to produce crease lines axially of said container interconnected by generally chordal segments.

8. Apparatus for embossing a container comprising a base having a mandrel rotatable about a fixed axis thereon, and loading means on said base axially aligned with said mandrel for loading a container on said mandrel, said mandrel being formed from a rigid non-deformable material and having circumferentially-spaced, axially-extending projections on a periphery thereof, and a resilient member rotatable on said base and engageable with said mandrel to deform said container along said projections to produce crease lines along said container and interconnected by generally planar portions between said crease lines resulting in an embossed container.

9. Apparatus for providing embossments in the side wall of a metal container comprising a mandrel having an elongated member adapted to at least partially extend into the container, said member having an outer peripheral surface adapted to engage the inside of the container side wall, embossing means on said outer peripheral surface of said core, means for moving a container onto said mandrel, a resilient member supported adjacent said mandrel, means for moving said resilient member into and out of embossing pressure engagement with a container on the said mandrel, and drive means for rotating at least one of said mandrels and said resilient member to produce relative rotation in opposite directions between said mandrel and said resilient member to emboss said containers, said embossing means deforming the container side wall while stretching the metal to produce crease lines in said container side wall.

10. Apparatus as defined in claim 9, wherein said embossing means are axially extending, generally parallel and extending along a substantial portion of said container side wall.

* * * * *